United States Patent [19]

Watts

[11] 4,385,260

[45] May 24, 1983

[54] BARGRAPH DISPLAY

[75] Inventor: Geoffrey P. Watts, Mesa, Ariz.

[73] Assignee: Beckman Instruments, Inc., Fullerton, Calif.

[21] Appl. No.: 611,743

[22] Filed: Sep. 9, 1975

[51] Int. Cl.[3] ..... H01J 61/06; H01J 61/30

[52] U.S. Cl. ..... 315/169.2; 340/754; 445/24; 313/583; 313/609; 313/632

[58] Field of Search ..... 315/169 R, 169 TV, 169.2; 340/166 EL, 173 PL, 324 M, 336, 754; 316/1, 17; 29/25.1, 25.15; 313/514, 517, 519, 188, 210, 204, 217, 220

[56] References Cited

U.S. PATENT DOCUMENTS 3,863,087 1/1975 Holz ..... 313/188

*Primary Examiner*—Eugene La Roche

*Attorney, Agent, or Firm*—R. J. Steinmeyer; F. L. Mehlhoff; William H. May

[57] ABSTRACT

Bargraph displays wherein the illuminable bar segments are formed by winding filamentary conductors upon a mandrel.

11 Claims, 14 Drawing Figures

BARGRAPH DISPLAY

FIELD OF INVENTION

The present invention related to electrode arrays in a "ladder format," particularly useful for gas discharge display devices of the planar, raised-cathode type—especially those adapted for information display in the fashion of a "bargraph". More particularly, it relates to improvements in such devices involving a plurality of like parallel aligned cathode strips adapted to provide visual signals as human-readable informational indicia, the value of which is indicated by the position of an illuminated cathode strip within a display field.

BACKGROUND; INVENTION FEATURES

In the art of data display, workers tend to categorize displays into "analog" and "digital" types. An "analog" display is exemplified by a meter needle (a pointer, e.g., on a d'Arsonval galvanometer) or by the position of a movable element, such as a column of mercury, in a thermometer.

On the other hand, a "digital" display is represented by alpha-numeric symbology, with a change in information content being represented merely by a change in the symbology (e.g., numbers displayed in a given field); as opposed to a change in position, color, etc. for the analog case.

There is presently a need in the art for analog displays which coact with digital input (i.e., respond to digital information input), principally because it is commonly convenient to gather and process information in digital form. There is also a need in the art for displays which render an analog presentation responsive to either digital or analog (electrical) input signals. The present invention is directed towards facilitating this.

This invention is directed towards providing such an analog display of electrical signals and particularly, to do so using raised-cathode gas discharge (RCG) display devices, especially as represented in a "bargraph" display. Such might be characterized as a "digitally-formulated" analog display.

As workers know, a bar type display may be characterized as an indicating device where the length or height of the indicating medium is proportional to the magnitude of the measured quantity. For example, a mercurial thermometer is a simple form of a bar type display, the height of the column of mercury being proportional to the temperature. Bar type display devices have potentially wide application in industrial process controls, aircraft instrumentation and, in general, in systems which require the mounting of a large number of displays on a relatively small instrument panel. To be useful in many of the potential applications, such display devices must be capable of responding rapidly to digital input signals, must occupy a minimum amount of space and must operate under a wide variety of environmental conditions.

Electro-mechanical devices for providing bar type displays are well known to the art, but these devices generally have the disadvantages of slow response time, of being relatively bulky and of limited accuracy when subjected to shock and vibration, and consequently have found only limited acceptance as display devices. Electrical devices are also known for providing bar type displays. A bargraph display is often a more natural and acceptable display representation of a variable than a digital readout—particularly when one wishes to quickly scan a number of displays for "out-of-range" indications, presenting analog data with digital accuracy.

Two methods of operating bar graph displays—"-stepping" and "direct drive"—will be described along with the advantages of each. "Direct drive" is discussed below and is the operative mode of the described bargraph display embodiment.

By contrast, in the "stepping" mode of operation, only one gas discharge exists at any one time between the common anode and any cathode bar segment. The discharge is initiated at the lower end at a separate cathode, the "reset cathode"; and, once so initiated, provides a supply of ionized and metastable atoms, having a relatively high density in the area of the cathode adjacent the reset cathode. The presence of ions and metastable atoms results in a considerable reduction in firing voltage for this adjacent cathode (the "phase-one" cathode). Because there are a number of such "phase-one" cathodes connected in parallel, such a reduction in firing voltage—for any electrode adjacent another bar-electrode which is "ON" (discharging-glow)—is essential to a "stepping" operation. With only three (or more, if desired) parallel-connected sets of cathodes, and a "reset cathode" to start the first discharge, a glow can be stepped from cathode to cathode with any limit in the number of cathode bars.

The present invention contemplates improved bargraph displays of the known gaseous discharge type wherein a "glow" is typically established at a reset cathode and then, by the glow transfer principle, transferred up a series of spaced bar-cathodes. These electrodes are arranged as a "ladder" and when viewed at normal range can readily be made to appear to merge into a continuous bar of controlled length corresponding to the number of "digital counts" represented by glowing bars.

Now, various workers in the art have addressed problems like these (e.g., see U.S. Pat. Nos. 3,258,644; 3,328,790; 3,343,155; 3,659,149; 3,689,912 and 3,824,581). For instance, it has been proposed to provide a display which converts electrical input signals, such as BCD (binary coded decimal) signals, and presents them in a visual analog display with the magnitude (and/or sense) of the signals being represented by "indicator position" within the field. The display field might, for example, comprise a rectilinear array of bars, or "bargraph," with all segments between the minimum analog value and the indicated value illuminated uniformly to simulate a solid bar. In some such arrangements, a numerical value is indicated by the activation of a particular luminous segment—one of many in an aligned, parallel array, the segments being preferably visually contiguous, identically shaped and activatable so as to be independently illuminated. Such segments visually indicate increasing position-encoded values along the array. This invention provides improved techniques for a "ladder" array of electrodes for a bargraph display.

Such a display may be driven by electric circuit means responsive to the input signals and adapted to select and illuminate a specific luminous segment corresponding to the encoded value—thus, signal magnitude is indicated by illumination of a segment along the "bar array." The present invention is adapted to improving such "bargraph" displays, especially where the arrayed indicator segments, comprise planar, raised gas discharge cathodes.

Of course, RCG display devices are, in themselves, well known. They are typically arranged to indicate alpha-numeric symbols by the illumination of cathode substrates which combine to form a display symbol. Such cathodes coact with a confronting anode (typically a transparent film on a faceplate) to selectively provide the desired illumination as a cold-cathode glow discharge. Usually the electrodes are mounted on a ceramic baseplate and packaged in an envelope provided with a transparent window, being hermetically sealed with an ionizable gas therein. Cathode glow patterns are viewed through the window as display information (e.g., see U.S. Pat. No. 3,675,066 to Armstrong, Schott and Warne, and U.S. Pat. No. 3,675,065 to Warne, describing typical structure, fabrication and operation of such devices—also see FIG. 14).

Typically such arrangements place the anode adjacent to the transparent faceplate (e.g., a transparent conductive tin-oxide coating thereon), while the opposing cathodes are mounted upon the envelope base and arranged to coact with their anode so as to be selectively illuminated. Such cathodes typically comprise conductor strips mounted on pins in the envelope base and coupled to electrical power to be selectively excited. The anode and cathode elements, together with other conventional associated parts (such as spacers, bases, mounting pins and fill tube) are mounted in an envelope which is sealed, evacuated and partly backfilled with an ionizable gas, such as a neon mixture known in the art. For excitation and display, electrical power signals are applied between an anode and one, or several, associated cathodes so that the gas around these cathodes is discharge-excited into visible luminescence, the glowing-cathode array thus forming the intended information symbol. The present invention is arranged to utilize such raised-cathode gas discharge technology in a novel form and especially to provide an improved "bargraph" display.

SUMMARY OF THE EMBODIMENTS

One object of this invention is to provide an improved design and construction method for an array of "ladder electrodes." A related object is to provide such for use with a bargraph display. Another object is to provide such a "ladder" of raised-cathode electrodes simply by winding wire.

Yet another object is to teach techniques for forming such an electrode "ladder" by winding conductive filaments upon a prescribed mandrel—thus avoiding fussy, expensive multiple-deposition techniques.

A further object is to so provide a "ladder" of raised-cathodes which are readily arranged in "glow-overlap" relation to provide an improved high-speed, stepping bargraph display.

Yet another object is to provide such a display in conjunction with "glow-barrier" means to limit glow length. A related object is to provide such in conjunction with "seal-isolation" means provided adjacent to the display envelope seal and adapted to accommodate excess sealant.

Still another object is to provide such a "ladder" electrode array according to techniques which facilitate construction and operation of an improved "direct-drive" bargraph display. An alternate object is to provide such a "ladder" array of electrodes for a "stepping" bargraph display using multi-wire/ribbon winding techniques. Another object is to provide a "non-raised" ladder array of electrodes bound directly upon a mandrel.

Another object of the present invention is to realize an improved raised-cathode discharge device having simple construction and high reliability at relatively low cost.

Another object is to provide an improved cold cathode glow discharge as a bargraph or related "pointer" display. A related object is to do this employing simple mechanical methods and structures, and particularly to eliminate multi-deposition techniques, or other complex, expensive fabrication techniques. A further related object is to do this in conjunction with providing structure accommodating anode placement either in front of, or behind, the cathode array. Another related object is to provide an improved "cathode-ladder" construction and associated activating interconnections simply by winding wire upon a suitable mandrel-base.

Other objects, aspects and features of advantage of this invention will be pointed out and demonstrated in or be apparent from, the detailed description following below, especially as considered in conjunction with the following drawings.

DESCRIPTION OF THE DRAWINGS

FIG. 12 is an upper perspective view of yet another embodiment; while

A PREFERRED EMBODIMENT

Figure 1:
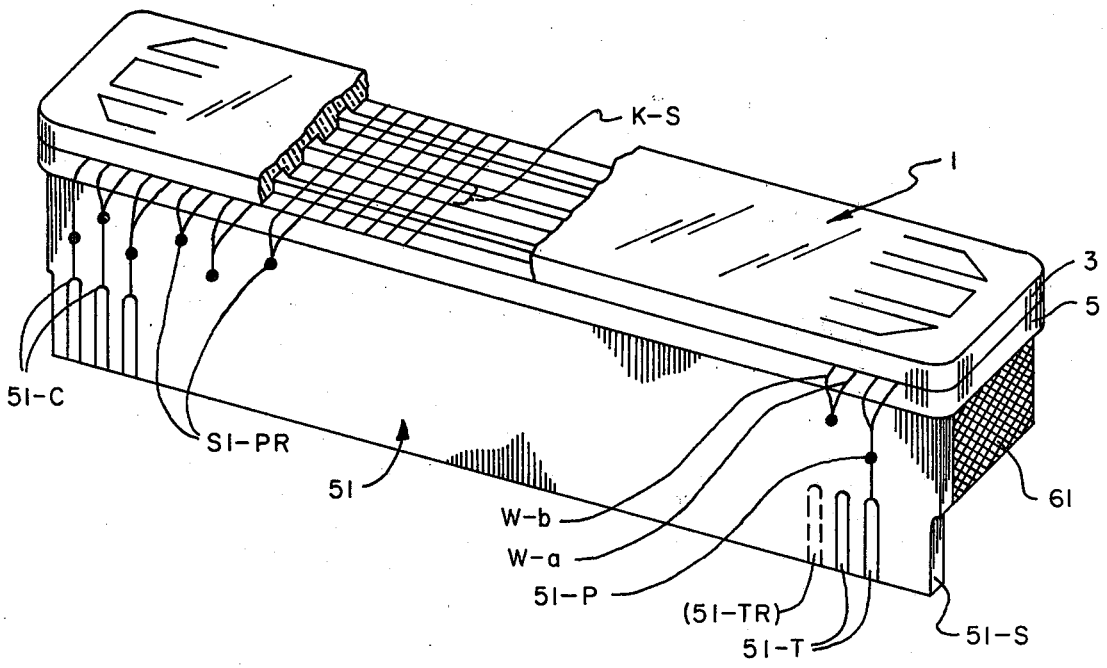
FIG. 1 is an oblique elevational view of a first embodiment of the invention, with the gas tube portions thereof shown in schematized cross-section in FIG. 2 and a plan view of the embodiment shown in FIG. 4 in a schematically indicated display environment.

A "direct drive" bargraph display embodiment I is made according to various aspects of this invention. FIG. 1 illustrates the finished display including mandrel 5 and faceplate 3 as mounted upon a mounting block 61 and coupled electrically to a printed circuit board (PCB) 51 ready for mounting into a display setting and to be operatively associated with a direct drive electronic control unit (coupling to PCB—e.g. see circuit of FIG. 7).

Figure 3:
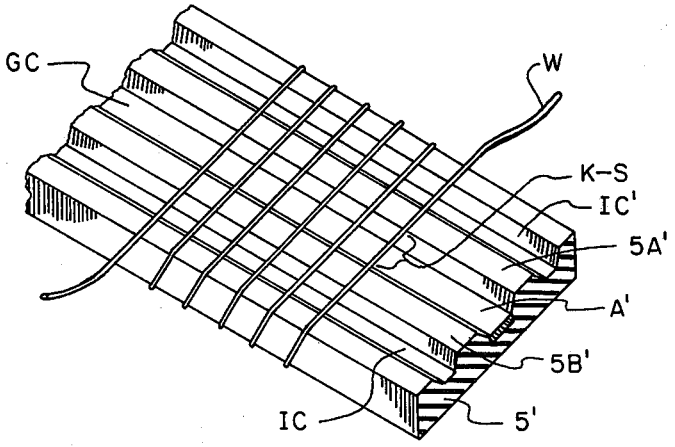
FIG. 3 is an oblique view of the mandrel portion of this embodiment partly constructed and FIG. 5 is a plan view of the same somewhat more completed.

Mandrel 5 constitutes the display-tube base as well as the "form" on which the "ladder" array of wire segments w is wound and mounted; this winding presenting each top segment (turn) in operative, cold-cathode-display relation with another electrode means and associated electronic drive means. As better seen in FIGS. 3 and 5, the mandrel 5 is thus constructed to present a novel "back-plane" anode (electrode strip A) at a prescribed discharge-distance from the upper medial segments of each turn wound on the mandrel, and "behind" them (i.e. away from the viewer). These cathode segments are presented as fixed, regularly spaced turns—i.e. a "ladder" format—on mandrel 5, being wound (e.g. manually, or by machine as known in the art) thereon as a continuous-wire conductor, with inter-segment pitch being established by stepping the winding a prescribed distance across the "back" (non-discharge) side of mandrel 5. As workers know, cathode spacing is one factor determining firing voltage, and accordingly, the turns should be close enough together to effectively transfer the glow and quick, when activated in the known manner.

Preferably, the position of each turn may be established and held merely by the frictional engagement of wire and mandrel. Also, and preferably, at a later stage in manufacture, envelope seal material is provided to both vacuum-seal the interior of the display and to fasten the wires permanently to the mandrel and faceplate.

Figure 2:
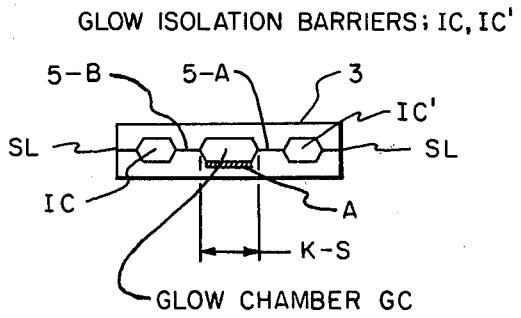

The mandrel 5 (FIG. 3) thus establishes a central discharge zone, or glow chamber GC, defined by a pair of opposed (glow isolation) barriers 5-A, 5-B, abutting the upper surface of the cathode wires and serving to limit the spread of glow along the wire lengths (see sectional view in FIG. 2). Barriers 5-A, 5-B also serve, as a convenient novel feature, to electrically isolate the glow zone (discharge segments) as well as to define the discharge-length K-S of all segments. For instance, in this embodiment, the common anode strip A is mounted between them at the bottom of chamber GC, and may be fixed there quite conveniently; e.g. by merely inserting and "fusing-in" a metal strip or by known equivalents (e.g. deposited film). The chamber height thus serves to define a constant inter-electrode gap according to this useful feature.

Preferably, and according to another feature, the display face (top) of mandrel 5 is also provided with a pair of isolation chambers IC, IC' (see FIGS. 2, 3 and 5 also) to assure that the cold-cathode glow will not extend beyond the glow stopping bars 5A and 5B, as well as to accommodate any excess sealant from the seal area.

Figure 5:
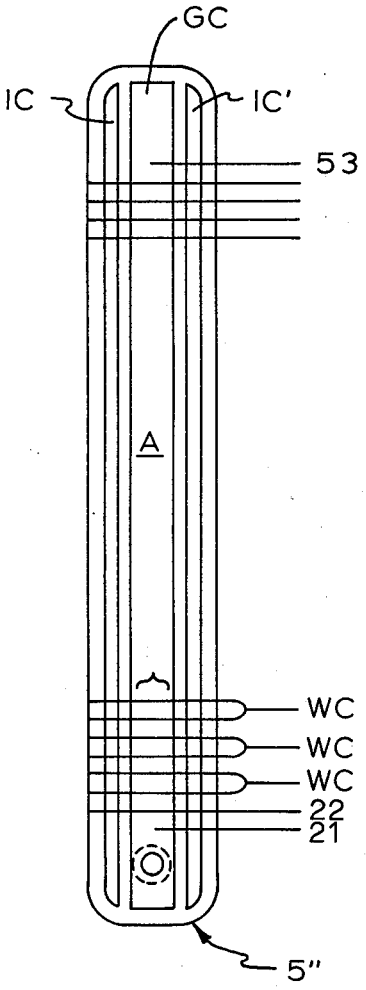

FIG. 5 may be understood as illustrating the semi-finished condition of mandrel 5, with wire wound and affixed thereon (as per FIG. 3); however, but after the wire turns have been cut (along right-rear, FIG. 5) and pulled-out (to left) preparatory to connecting the segments for driver-coupling (i.e. connection to terminals on PCB 51). This specific embodiment connects adjacent wound turns in pairs (see soldered windings w" FIG. 5) with each free end, adapted for connection (e.g. solder) to a respective terminal on PCB 51. Of course, this mode of connection may be varied, i.e. either with every turn activated separately, or with every other turn left unconnected to a driver, or with "triplet" connections, etc.

Figure 6:
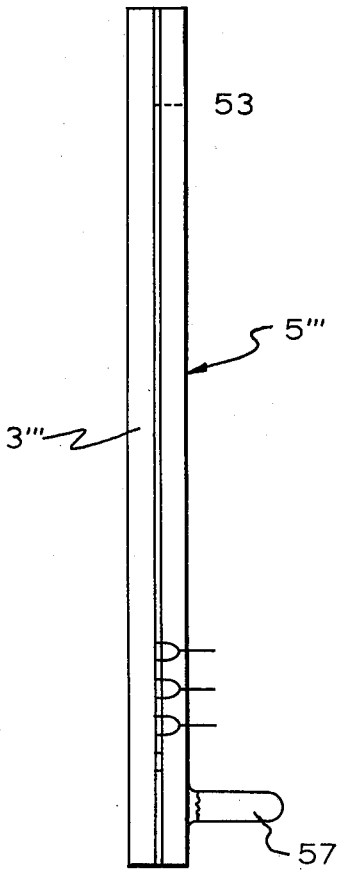
FIG. 6 is a side elevation of this display tube partly finished.

With mandrel 5" so arranged (FIG. 5), it may then have faceplate 3 affixed thereon to provide an air-tight closure about zones GC, IC, IC' and provide a transparent display-window for viewing cathode segments K-S (bars") as well known in the art. For instance, faceplate 3 may be affixed with glass frit adhesive (not shown but well known) applied to the periphery of mandrel 5 (see FIG. 6). As workers in the art will appreciate, a keep-alive cathode 21 and associated anode 22 is also provided, along with a connection 53 for common anode A. Reset electrode means (not shown, but well known) are also preferably provided adjacent the first "bar" to initiate each display sequence. A suitable glow-discharge gas fill and associated electrical arrangements are also used as well known in the art (e.g. see cited patents).

Preferably, faceplate 3 is molded from a soft glass (e.g. ordinary "window glass"), while mandrel 5 is molded from a similar glass (same thermal coefficient of expansion or "TempCo") but pigmented black for optimum display contrast. Anode A and cathode wire w should also be closely matched in "TempCo" to this glass. Anode A may preferably comprise a strip 1–2 mil thick of a nickel-iron alloy, that will also heat-fuse to glass mandrel 5 (while being heat-molded, in a reducing atmosphere). Insulating block 61 (FIG. 1) serves to mount mandrel 5 and PC board 51 in fixed relation, while also protecting the exhaust stem.

Thus, mandrel 5 may be understood as an insulative body so formed and suitably dimensioned; preferably comprised of opaque, colored glass in generally rectangular form with channels IC, IC' and GC formed (molded) therein; its dimensions, here, being on the order of $\frac{1}{2}''$ wide$\times 3''$ long$\times \frac{1}{4}''$ high. Lid 3 which is made from clear transparent glass (faceplate) may be a mirror-image (molded) piece according to a feature of convenience. Anode strip A may comprise a thin (1–2 mil) strip of metal matched to the glass in coefficient of expansion, lodged in channel GC (in an offset therein) and bonded to mandrel 5. Wire w may comprise a length of 8 mil round iron-nickel alloy matched to the glass in coefficient of expansion and wound on mandrel 5 to present 101 (only 96 used) turns along about $2\frac{1}{2}''$ of the medial length of the mandrel, spaced uniformly and parallel on its top (display) surface about 50 mils apart. When so tied in pairs, fifty (50) double-wire cathodes will be presented to be driven as a bargraph display.

Preferably, mandrel 5 is also provided with exhaust port means to allow evacuation and gas filling; here (FIGS. 5, 6) an aperture 55 is drilled through one end of the mandrel 5 and registering exhaust tubulation 57 (glass) is attached, this being sealed off after filling, as is conventional.

As seen in FIGS. 1 and 5, electrical connection means is provided to the bar segments (here 50 wire pairs tied to segments WC) by PC Board 51, mounted, with the display tube, onto block 61. Insulating board 51 is relatively conventional, presenting a set of connector terminal tabs on each side (front set 51-T; rear set 51-TR), each tab being connected to a respective solder post (through-hole posts 51-C for front tabs 51-T; "thru-hole" posts 51-PR for rear tabs 51-TR) by connectors 51-C. With posts 51-P, 51-PR formed as hollow posts, leads WC may be conveniently inserted therein and soldered-in as shown in the art. Block 61 acts as an insulative mount and PCB stiffener and may comprise any insulator bonded to board 51 and to the display (e.g. epoxy bonded).

Figure 4:
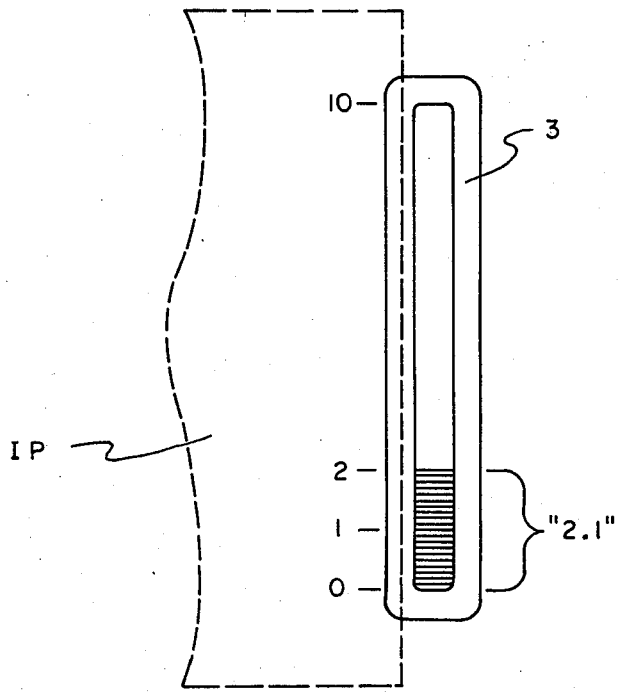

FIG. 4 indicates a typical use of bargraph display embodiment I and may be understood comprising as indicator panel. If mounted (e.g. on an aircraft instrument panel) so as to present "indicator indicia" (here, numerals 0–10) operatively adjacent the bargraph cathode segment "ladder"—here a value of 2.1 is exemplarily shown.

It will be understood that display I will be arranged and coupled to a source of signals adaptable to apply "digital form" information representing analog, bargraph values to the wound cathode segments (pairs tied to WC) on mandrel 5 and to thereby initiate a series of adjacent (usually contiguous) bar-glow representations forming the resultant "bar value" (here, 2.1).

According to a novel feature thereof, a raised cathode gas display is taught wherein the anode is mounted "behind" the cathode rather than in front. Workers will appreciate that, unlike other displays (e.g. screen printed displays for example), the raised-cathode type (see U.S. Pat. No. 3,675,066) allows the use of an anode mounted "behind" (as viewed from the front of the display) the raised cathode structure. Such a "back-plane-mounted" anode has the advantage of being much less expensive to provide than the tin oxide (NESA) transparent anodes common to the art; also such anodes can be more accurately positioned relative to the cathode structure; further, the electrical connection to such an anode is more readily accomplished.

This disclosure specifically describes the use of such a "back-plane" anode (any electrically conducting material mounted behind the cathode structure) whether the application be for a bargraph display as herein described, for a multiple segment display (such as the Beckman planar gas discharge displays—see SP-series) or for any other similar structure.

Driver Electronics

Workers will recognize that a bar graph display like embodiment I is well adapted to employ prescribed types of driver arrangements. One such driver I-D, is shown schematically in FIG. 7 with 48 cathode connections. Drive I-D comprises six, eight-unit cathode driver units (CD-1 through CD-6), each coupled to be driven by an associated eight-bit shift register (e.g. SR-1 for CD-1, etc.) those registers being connected to operate in sequence; plus a common control signal means $I_{KC}$ (providing cathode current control and duty-cycle input). Each driver unit CD has eight output terminals, each coupled to drive a respective bar segment (double-cathode lead WC) as known in the art. A source of anode current V-A is also shown, along with data clock means for each register SR, plus "data-in" signal means for initiating the register array and reset signal means for controllably resetting all registers. Means for implementing the above functions are well known in the art and will not be detailed here.

Direct Drive Bargraphs

A "direct drive" bargraph display will be understood as using a separate drive input for each cathode element and coupled directly thereto. No "stepping" is involved, and all bars can be "on" at the same time, allowing up to 100% duty cycle. Direct drive has several very important advantages, among them:

a. Brightness of 300 ft. lamberts and more is readily possible.
b. Dimming ratios of 100 or more are possible.
c. Several displays may be multiplexed. Multiplexing allows use of common cathode drivers for several displays, with anode drivers selecting and driving displays in a repetitive sequence.
d. Repetition rate of 200 Hz and more are readily obtainable for bargraphs of 2% or better resolution.
e. A "Solid bar" presentation and one or more pointers, and like display features, can be much more readily generated with direct drive displays.
f. The display is more reliable because "false-stepping" cannot occur, also a break in a single connection is not catastrophic as it is with a "stepping" tube.

The cost of direct drive is, however, higher because of the extra complexity of the driver electronics and the large number of electrical connections required.

Figure 7:
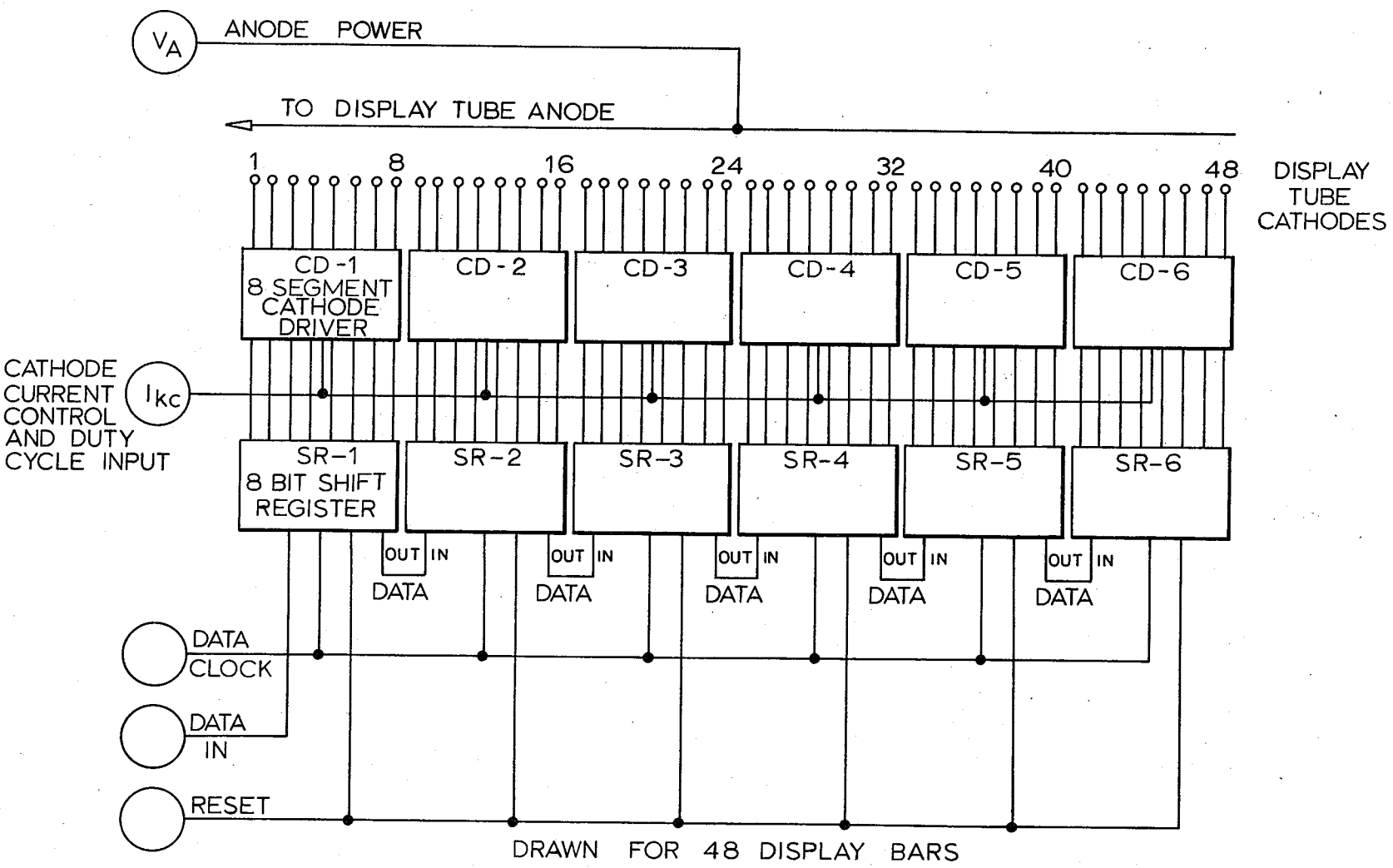
FIG. 7 is a schematic diagram illustrating the manner of operating this embodiment and associated electrical signal sources.

A most straightforward way to operate a direct drive display is shown in FIG. 7. A shift register shifts data to the right with each applied clock pulse. If the register is first reset, and the data are all "ones" ("cathode-activate"), then a solid bar is generated; the height of the bar being controlled by the number of clock pulses after the reset pulse. If a "pointer" display is desired, a single "one" pulse (at the data input) is shifted to the required position, with all other data inputs (cathode-activate signal) set to zero ("off").

As an example, the following characteristics are achievable with the drive scheme and embodiment shown, assuming a single ⅛" wide bar, using 0.008" diameter cathode wires and operating at 400 Hz repetition rate.

a. Maximum brightness—300 ft. lambert
b. Minimum brightness—3 ft. lambert
c. Dimming ratio—100:1
d. Maximum on time—2500 μsec.
e. Minimum on time—25 μsec. (sufficient for reasonable glow uniformity)
f. "Segment-on" current—500 μA/segment.

Embodiment Variants

Figure 8:
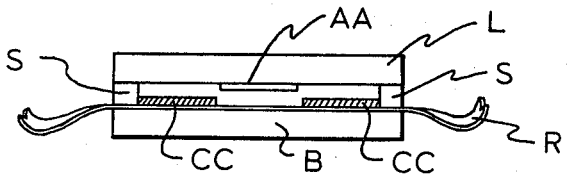
FIG. 8 illustrates an alternate embodiment in schematic side section.

Workers will appreciate that the teachings herein may be employed for applications beyond those specified. For instance, it will be apparent that the wound conductor need not, in all cases, be round or even symmetrical. In certain cases a flat ribbon will serve as indicated schematically by ribbon R in embodiment II, FIG. 8. Here, ribbon R will be understood as wound upon mandrel B and kept in contact therewith (especially across the glow discharge zone confronting anode A) to form a "non-raised" cathode and preferably, also being "masked" to prevent glow discharge, at outboard, non-viewing segments indicated at CC (e.g. simply by overcoating with a dielectric fiber). The anode A may be provided as a translucent coating on transparent lid L sealed, with spacers S, to mandrel-base B. Workers will recognize that this mode very conveniently and advantageously makes conventional, fussy cathode-deposition (and associated connector and insulator deposition) techniques unnecessary.

Figure 9:
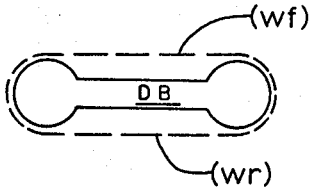
FIG. 9 illustrates another alternate embodiment in very schematic cross-section.

The mandrel may also provide a "two-faced" gas display as indicated very schematically for unit III in FIG. 9 where a "dog-bone" mandrel DB accommodates cathode windings w apt for presenting "front" and "rear" discharge segments (wf and wr, respectively).

Figure 11:
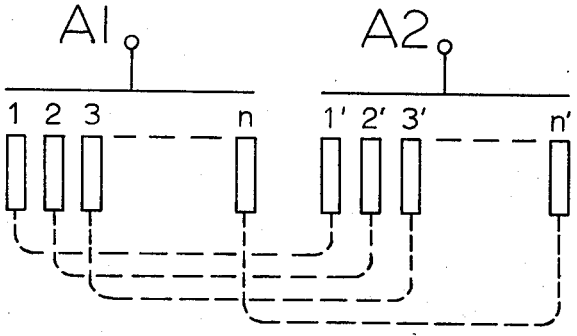
FIG. 11 is a schematic diagram illustrating still another embodiment, rather functionally.
Figure 10:
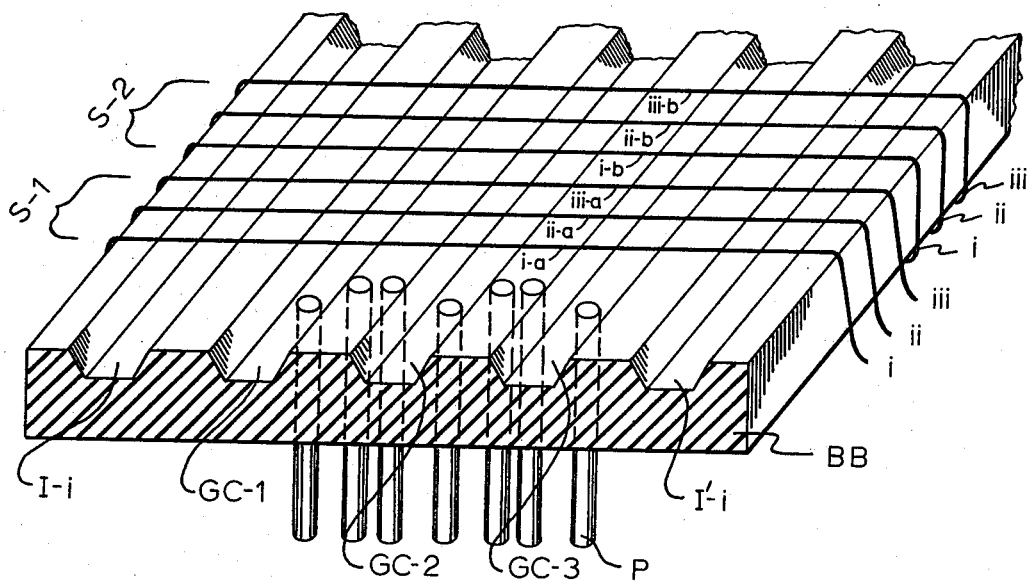
FIG. 10 is a schematic oblique view of yet another embodiment in partly constructed condition.

Such gaseous-discharge displays may alternatively be implemented using a "multi-anode" control over cathode selection, rather than only "stepping" with one anode; and will allow the display to function as a "pointer" (only a single "bar" illuminated at any one time) rather than as a "bargraph"—while still advantageously employing a "wound ladder" cathode array as indicated before. Embodiment V in FIG. 11 illustrates this. Here, cathodes 1, 2, 3—n will be understood as comprising "n" filamentary conductors wound upon a mandrel (not shown) to present a plurality (N) of multi-cathode sets, or "turns", each set having its own discharge-exciting anode (e.g., anode A-1 for cathodes 1', 2'—n'; etc.)—n×N being the total number of bar segments). A related "multi-filar" winding arrangement is also shown in FIG. 10 and could be operated as understood from the foregoing.

Keep-alive means KA is also provided preferably in the foregoing display tubes to allow discharge-activation of any cathode (wire) energized—provided of course that a corresponding (only one) anode is energized contemporaneously with the selected wire (e.g., anode A-1 and cathode 2 pulsed simultaneously to initiate discharge therebetween;—thus only cathode No. 2 will glow—e.g. instead of 2' if A-2 were pulsed rather than A-1). Such operation is known in the art (e.g., see "half-select" activation modes). This foregoing very schematic (especially for anodes) showing will indicate such operation to those skilled in the art.

With related, "multi-filar" winding arrangements some very novel, advantageous "stepping" types of gaseous bargraph displays may be provided. Such an embodiment IV is indicated in FIG. 10 where three wires (i, ii, iii) are, very schematically, indicated as wound, repeatedly as a set, about a mandrel base BB to present any number of turns (as in FIG. 11); while using only one, common anode (plus reset electrodes to initiate discharge—neither being shown, but well known). Here, a repeat-sequenced energizing of the (3) wires will be understood as applied to "step" a glow display along the mandrel to thereby create an expanding "bar" presentation of the type indicated in FIG. 4 (see above). Thus, it will be appreciated that, according to known implentation techniques, display IV will generate display columns, discharging a given, selected number of cathode-bars according to how long the (automatic, once initiated) cycling activation of wires i, ii and iii is allowed to continue.

For example, once the anode and reset electrodes are fired, discharge potential will be applied to wire "C" (the first in order, thus illuminating bar segment i-a); then applied to wire ii (illuminating segment ii-a), then to iii (so that segment iii-a glows, too); then back to wire i again (now i-b glows, as well), etc. This "expanding-column-illumination" will terminate (cathode activation creases) when an illuminated bar-column of selected length has been generated (this corresponding to the magnitude of the applied input signal and the analog value represented thereby). Next, the column may be "turned-OFF" (glow entirely extinguished) by removal (or sufficient dropping) of anode potential. The foregoing and related techniques are well known in the art and need not be further detailed.

Embodiment IV illustrates yet another feature and advantage in that a single winding array can be used to provide a number of side-by-side gaseous displays. Here it will be seen that in addition to a pair of outboard isolation grooves I-i, I'-i, (like chambers IC, IC' in FIGS. 1-3, etc.), base BB presents three (3)—not just one—glow chamber channels, namely channels GC-1, GC-2 and GC-3!

Each such glow channel will be understood as adapted to co-act with the (common) cathode windings, and its own anode, etc., as in embodiment I above, to generate its own "bar" (glow column), with the cathode wires (i, ii, iii) being cyclically and sequentially activated as before (e.g., as for embodiment I).

Now, for a "single column" display like unit I above, column height may be controlled by suitably dropping the potential of the anode or raising that of the cathodes, or both at the appropriate time in the stepping sequence, as known in the art. However, workers will recognize that for a "multi-column" unit like embodiment IV, of course, only anode voltage control is available as a column-height control (since the cathode windings are common while each column has its own anode). Here, it will be recognized as a feature of advantage, this multi-display-column operation may be enjoyed for substantially the same cost and effort that a single-column display entails!

Workers will recognize that other such "multi-filar" winding arrangements may be employed to yield "stepped" bargraph displays employing various numbers of wires—as long as at least three (3) wires are used (to assure proper stepping only when a succeeding cathode wire is activated—e.g., with only two wires. The shift in activation from the first to the second wire may transfer the glow backward rather than forward! Also, the wrap-angle may, of course, be varied to a yield different angular cathode orientation relative to the mandrel axis as opposed to the orthogonal relation in embodiment I).

Figure 12:
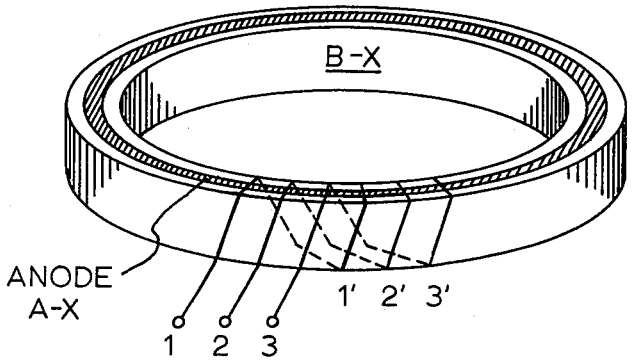
Figure 13:
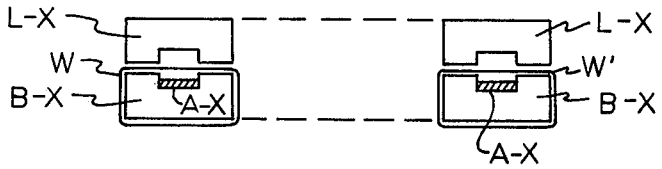
FIG. 13 shows a further related embodiment in side section.

Workers will also recognize that a multi-filar winding arrangement like that of embodiment IV (FIG. 10) can also be rendered on a "non-rectangular" mandrel. For instance, using an "endless toroid" mandrel as indicated, schematically, in FIGS. 12 and 13 (embodiment VI and VI'). Now, here windings 1, 2, 3 (called-out as 1', 2', 3', at the "second" turn) may be wound together, unidirectionally, on toroidal mandrel B-x with an associated common anode A-x set-into a discharge cavity found in, and around the top of toroid B-x (similar to embodiment I, above). An associated faceplate or lid L-x is also provided and this embodiment generally constructed and operated as described above except where otherwise indicated. For this "circular ladder" array, the column-glow (bar array) will be seen as presented around the toroid much in the manner of a "growing-ring" which is swept around a clock-face—the (angular) extent being selected according to the value to be represented (e.g., in the fashion of a "sweep-second-hand")—as opposed to a "rectilinear ladder" array.

Also, a "pointer", rather than a "bar", may be generated. As workers will recognize, the filamentary cathode ends may be tied into cooperation, or a continuous coil, if desired, and counting functions also performed, then, by the scanning display—(i.e. as a pointer, preferably) as workers will understand.

Figure 14:
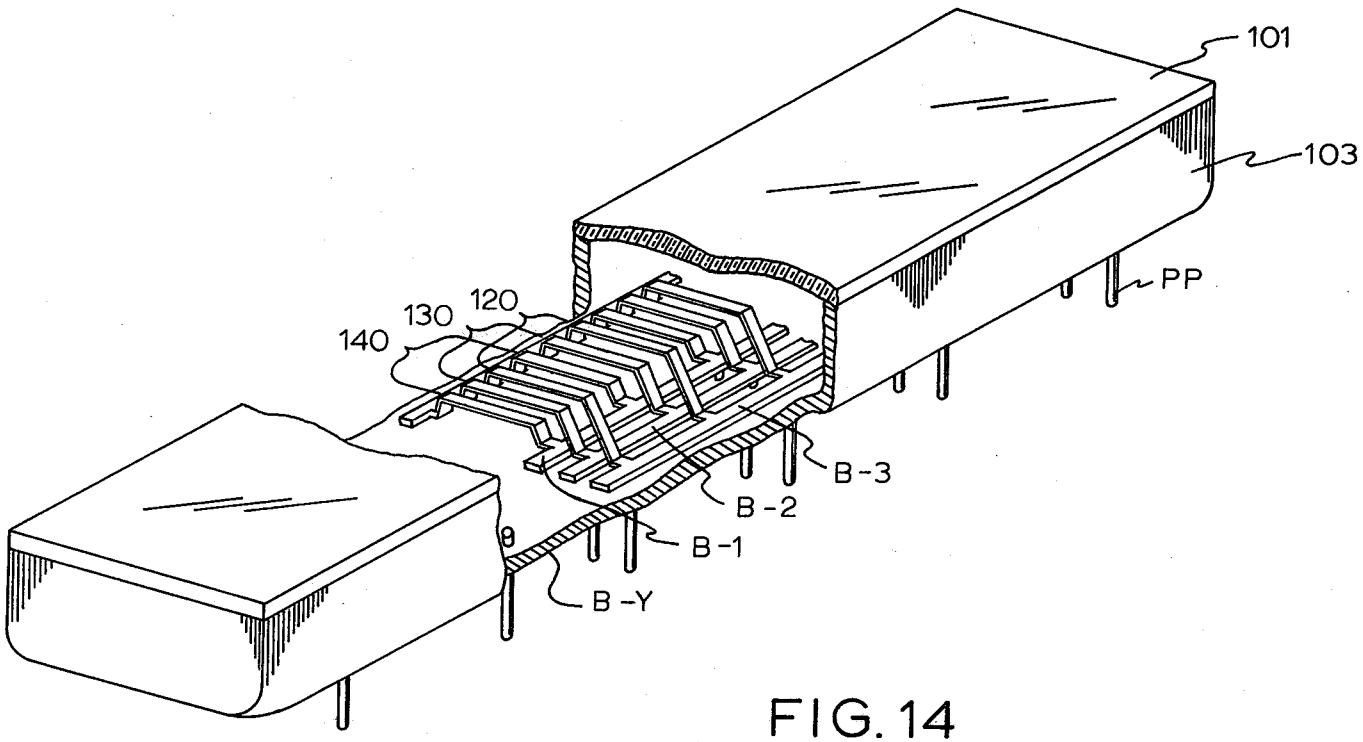
FIG. 14 is an upper oblique view of another related structure, partly broken-away for illustrative purposes.

By way of comparison, workers may be interested in considering embodiment VII in FIG. 14 where a "non-wound" ladder-array of bargraph cathodes is shown as adapted for raised cathode gas discharge display. Here, an exemplary set of three (3) sets of flat, coplanar raised-cathode groups is shown, constructed and interconnected in a somewhat novel manner, yet without winding upon a mandrel. That is, a first cathode set 140 (only two shown, by way of example) is mounted upon a substrate B-Y and specially interconnected by a "bus" arrangement B-1. Similarly, a second cathode set 130 with its associated bus bar B-2 is similarly mounted, cathode "bars" 130 being slightly longer at their outboard connecting portions than set 140 to facilitate interconnection. Likewise, a third cathode set 120 and associated bus bar B-3 is similarly provided, being slightly longer at connector-portions than set 130. A faceplate 10, including sides 103, is also provided and sealed to base B-Y to establish a discharge zone above the cathode sets in a known manner, with a thin-film anode (not shown) being understood as conventionally provided and operated to generate bargraph displays of analog values along the length of the unit—e.g. in the manner of embodiment II, above.

Although specific embodiments of the invention have been disclosed herein in detail to better illustrate the invention, it is to be understood that this is for purposes of illustrating the invention and its manner of making and using it and should not be construed as necessarily limiting the scope of the invention since it is apparent that many changes can be made in the disclosed structure by those skilled in the art to suit particular applications.

What is claimed is:

1. A gas analog display panel comprising:

a substrate having a front surface;

a plurality of continuous electrode wires wound around said substrate in alternating sequence, each turn of each of said plurality of wires around said substrate having a portion adjacent said front surface of said substrate, each of said turns being in alternating sequence with a turn of another of said wires to form a ladder array of said portions, each of said portions of an individual wire of each of said plurality of wires being electrically interconnected by the winding configuration of each of said plurality of wires around said substrate;

second electrode means positioned in operative relation to said electrode wires;

a transparent cover sealed to said substrate to form an envelope over said front surface of said substrate; and an ionizable gas contained in said envelope, to provide a glow discharge between said second electrode and any one of said wires for transfer along said ladder array by external electrical potential means connected to said second electrode and said wires to apply electrical potential in repeating sequence to said plurality of wires, said substrate has an elongated recessed channel within said front surface and wherein said second electrode means is positioned within said channel, said channel forming the glow discharge chamber.

2. A gas analog display panel as defined in claim 1 and additionally comprising means within said substrate for establishing a glow discharge barrier to limit the width of the glow discharge zone region along said substrate.

3. A gas analog display panel as defined in claim 2, wherein said glow discharge barrier establishing means comprises a recessed barrier channel on each side of said glow discharge channel chamber.

4. A gas analog display panel as defined in claim 1 wherein said substrate is toroidal in shape.

5. A gas analog display panel as defined in claim 1, wherein said plurality of continuous electrode wires comprises at least three separate wires each being a single wire continuously wound on said substrate member.

6. A gas analog display panel as defined in claim 1, wherein said plurality of continuous electrode wires are wound substantially parallel to each other on said substrate member.

7. A gas analog display panel as defined in claim 1 wherein said wires are in the form of flat cathode ribbons.

8. A gas analog display panel as defined in claim 1, wherein the number of said portions of said plurality of continuous electrode wires illuminated by said glow discharge establishes the magnitude of a bargraph.

9. A gas analog display device as defined in claim 1 and additionally comprising means connected to said electrode wires and said second electrode means for operating said device as a stepping bargraph display.

10. A gas analog display device as defined in claim 1 and additionally comprising means connected to said electrode wires and said second electrode means for operating said device as a direct drive bargraph display.

11. A gas analog display panel comprising:

a substrate having a plurality of elongated recessed channels;

a plurality of continuous cathode electrode wires wound around said substrate in alternating sequence, each turn of each of said plurality of wires around said substrate having a portion adjacent said front surface of said substrate, each of said portions of an individual wire of each of said plurality of wires being electrically interconnected by the winding configuration of each of said plurality of wires around said substate;

anode electrode means positioned within each of said channels;

a transparent cover sealed to said substrate to form a thin envelope over said front surface of said substrate; and an ionizable gas contained in said envelope, said plurality of channels providing a plurality of ladder electrode arrays along said display panel.

* * * * *